United States Patent [19]

Howard

[11] Patent Number: 4,706,472

[45] Date of Patent: Nov. 17, 1987

[54] REFRIGERATED COSMETIC STORAGE CONTAINER

[76] Inventor: Margot O. Howard, 6626 Gold Run Ave., Sacramento, Calif. 95842

[21] Appl. No.: 12,342

[22] Filed: Feb. 9, 1987

[51] Int. Cl.[4] ..... A47F 3/04

[52] U.S. Cl. ..... 62/246; 62/249; 62/252; 62/377; 62/457

[58] Field of Search ..... 62/3, 246, 249, 457, 62/377, 252, 251

[56] References Cited

U.S. PATENT DOCUMENTS

| | | | |
|---|---|---|---|
| 2,150,064 | 3/1939 | John et al. | 62/377 X |
| 2,298,790 | 10/1942 | Klassen | 62/249 X |
| 3,234,595 | 2/1966 | Weichselbaum et al. | 62/3 X |
| 3,500,649 | 3/1970 | Feldman | 62/3 |
| 3,732,702 | 5/1973 | Desch | 62/3 |
| 4,364,234 | 12/1982 | Reed | 62/324.2 X |
| 4,393,975 | 7/1983 | Moore | 62/457 X |
| 4,453,385 | 6/1984 | May | 62/3 |

*Primary Examiner*—Lloyd L. King
*Attorney, Agent, or Firm*—Mark C. Jacobs

[57] ABSTRACT

A refrigerated container for the storage of lipsticks. The device is sized to fit on one's bureau at home and the device includes various compartments to segregate individual lipsticks for storage as well as a section specifically for cooling the individual lipsticks prior to storage, after use.

19 Claims, 13 Drawing Figures

REFRIGERATED COSMETIC STORAGE CONTAINER

BACKGROUND OF THE INVENTION

Women who live in warm and/or humid climates find that it is difficult to store lipsticks in a solid state. Women whose residences are kept overly warm relatively speaking can suffer the same problem. When a lipstick melts, it become difficult if not impossible to have it retain its shape for application to the lips.

There is a need therefore for models and other beauty cognizant persons for a device for storage of lipsticks in a refrigerated state to render them perfectly suitable for application to the lips.

It is an object therefore of this invention to provide a lipstick refrigerator that can be stored on one's bureau.

It is another object to provide a lipstick refrigerator that has a plurality of compartments therein for the disposition of individual lipsticks.

It is yet another object to provide a lipstick refrigerator that has the refrigeration means mounted either internally or externally.

A further object is to provide a lipstick refrigerator storage device that includes a quick cool compartment or zone.

Still another object is to provide a refrigerator for lipsticks in various decorative configurations.

Other objects of the invention will in part will be obvious and will in part appear hereinafter.

The invention accordingly comprises the apparatus possessing the construction, combination of elements and arrangement of parts which are exemplified in the following detailed disclosure, and the scope of the application of which will be indicated in the claims.

For a fuller understanding of the nature and objects of the invention, reference should be had to the following detailed description taken in connection with the accompanying drawings.

SUMMARY OF THE INVENTION

A transportable lipstick electric powered refrigerator adapted to fit on a bureau for the cooling and storage of lipsticks.

DESCRIPTION OF THE PREFERRED EMBODIMENT

Figure 1:
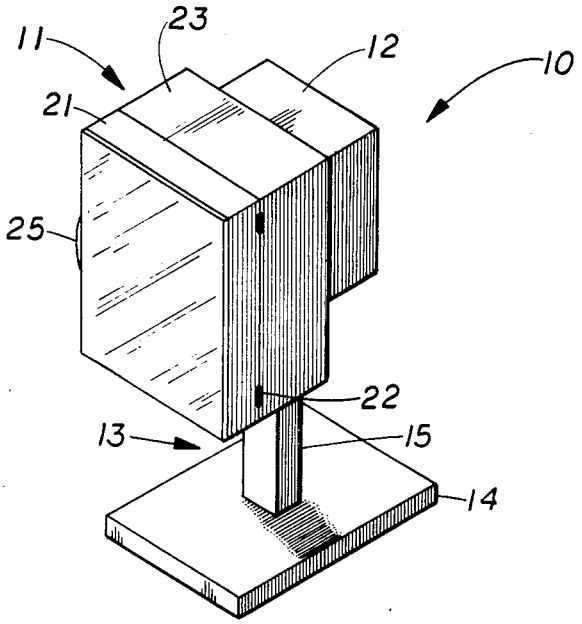
FIG. 1 is a front perspective view of the apparatus of this invention.
Figure 2:
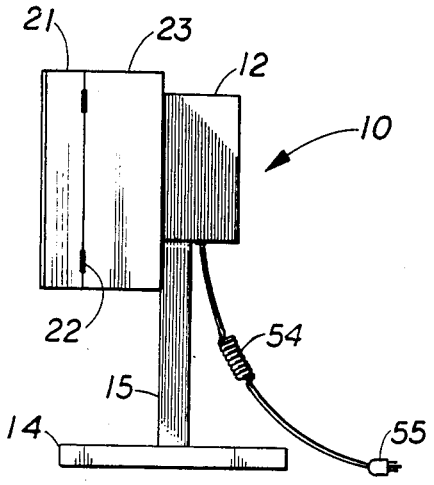
FIG. 2 is a side elevational view of the first embodiment of this invention.

In FIGS. 1 & 2 there is seen the main embodiment of the lipstick refrigerator 10 of this invention. The invention 10 includes three main components; namely a refrigerated storage section 11, mechanical section 12 and stand 13.

The stand 13 includes a vertical bore 14 in its upper surface, and a vertical post 15 suitably mounted therein. Optionally the stand can be weighted for stability if needed.

The refrigerated storage cabinet 11 includes a door 21 hinged (FIG. 2) on hinges 22 to storage section 23. Mounted on the rear of the storage section 23 and in refrigerant communication therewith is the mechanical refrigeration section 12. Door 21 has a handle 25 of any suitable shape on the side thereof. The handle is shown on the left with the hinges 22 on the right. Obviously the door can be made right hand opening by reversing the handles and hinges. A conventional magnetic closure system is contemplated to secure the door.

Figure 3:
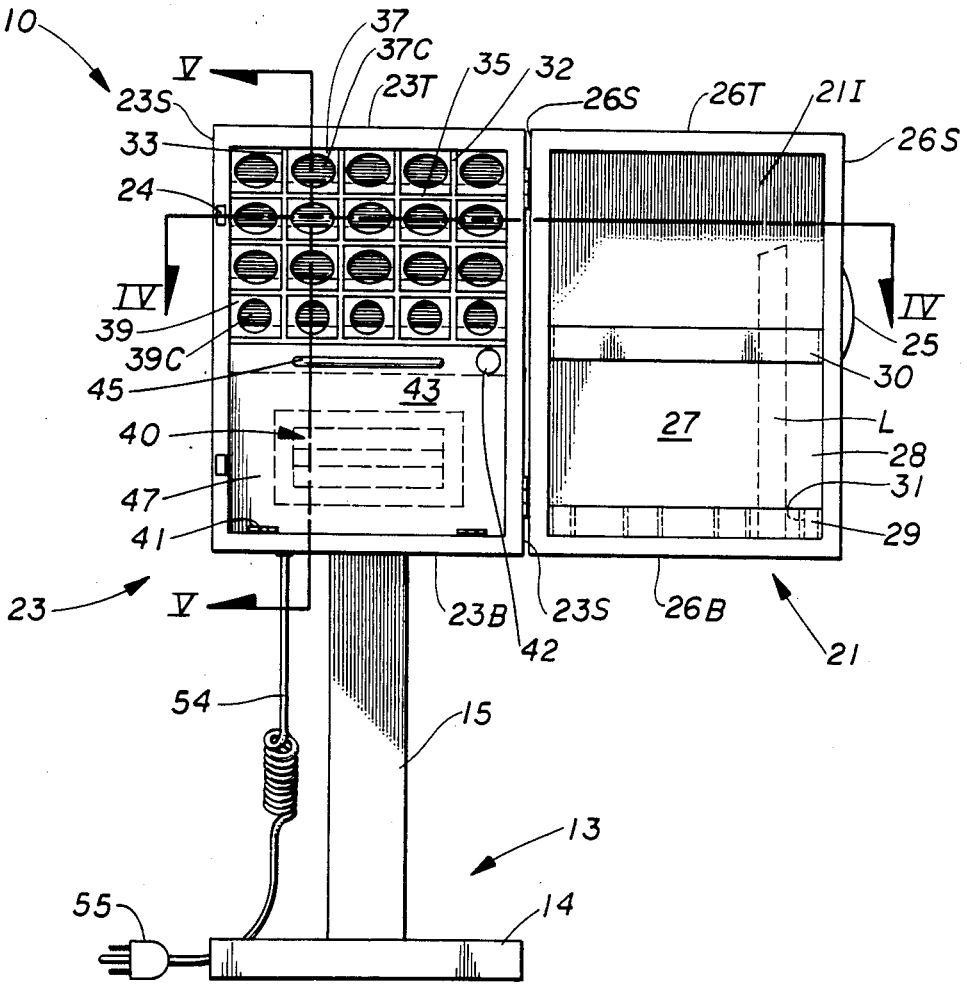
FIG. 3 is a front elevational view of the apparatus of FIG. 1 with the door thereof in open position.

Turning now to FIG. 3 there is shown door 21 which has an interior volume 27 which is defined by the spaced vertical walls 26S, top wall 26T and the bottom wall 26B which together create the interior volume 21L.

Figure 8:
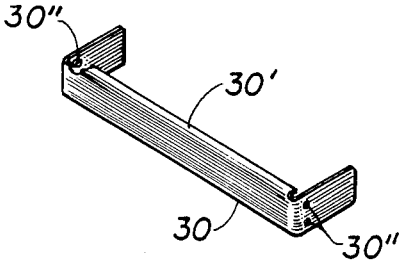
FIG. 8 is a close-up perspective view of one portion of this invention.
Figure 9:
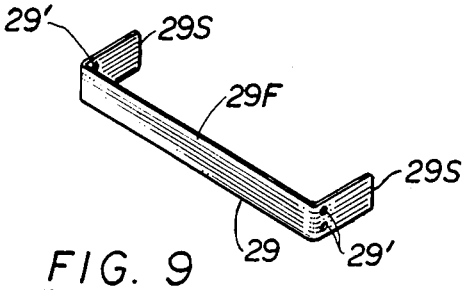
FIG. 9 is a perspective view of one element of this invention.

Retainer 30 is used to keep elongated lipsticks such as "L" shown in dotted line in place within the interior of the door 21T. Retainer 30, seen also in FIG. 8 is a one piece U-shaped plate 30 having an inwardly directed top 30' and at least one, here two aligned apertures 30'', through which conventional sheet metal screws can be inserted to secure retainer 30 to side walls 26S. Flange 30' serves to retain thin tubular items such as lipstick L as well as a restraint for plate 27.

Bottom retainer 29 is also of a one piece construction but lacks the inwardly directed flange. This retainer is also U-shaped and has two side walls 29S and a front wall 29F. It is attached to the door between walls 26S, while resting on door bottom wall 26B. Two aligned screw holes 29' are provided, though other attachment means are contemplated as well.

Disposed within the confines of 21L, the useable space within the door, rearwardly into the door from the rear surface of the front wall 29F of 29 are a plurality of individual U-shaped members 31 each resting on 26B and sized to receive an elongated tube of lipstick. The open end of U-shape members 31 face toward wall 29F to thereby form a rectangular compartment that is open at the top. See, FIG. 4.

Plate 27 which is optional, and which serves to further retain the lipsticks L along their lengths, fits between the heads of the screws that go into apertures 29' and 30'' of U-shaped members 29 and 30 and the front walls of such retainers as well as beneath flange 30' such that it, 27 maintains a vertical disposition adjacent and behind the front long wall of each of 29 and 30. See FIG. 3.

Figure 4:
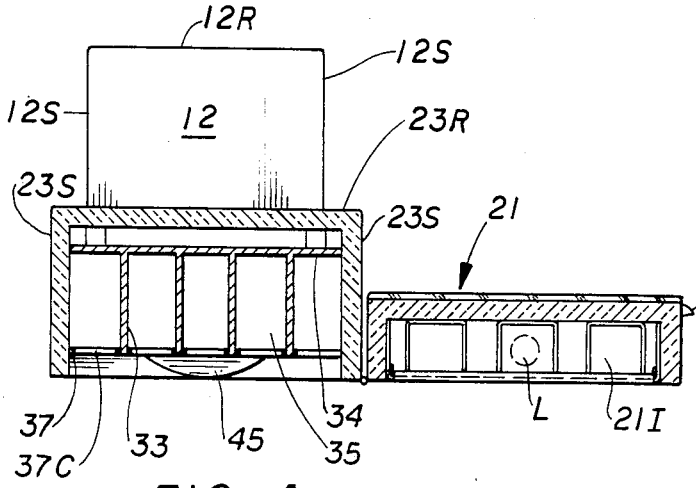
FIG. 4 is a sectional view taken along the line IV—IV FIG. 2.
Figure 5:
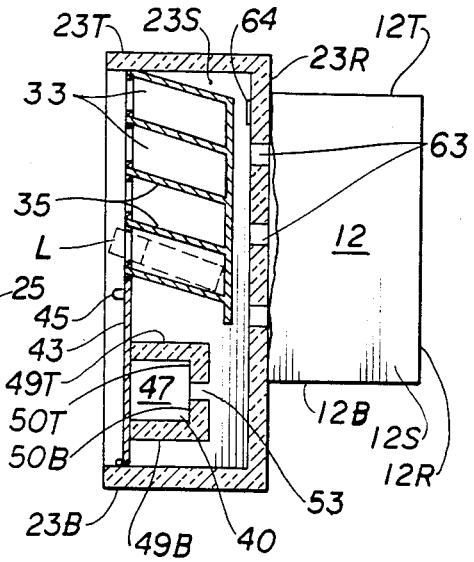
FIG. 5 is a sectional view taken along line V—V of FIG. 3.

While not mentioned specifically, it is to be understood that all walls of the compartments of the refrigerators herein, such as shown in the hatched areas of FIGS. 4 and 5 are to be suitably insulated and is known in the refrigerator art.

The discussion turns now to the storage section 23, which is seen in FIGS. 3, 4 and 5. This section has a pair of side walls 23S which are spaced from each other, a rear upstanding wall 23R, a top wall 23T and a spaced therefrom bottom wall 23B. Section 23 is open at the front and is closed off by the hinged door 21. Section 23 includes storage grid portion 32 and cooling zone 40.

Disposed between the aforesaid top, bottom and side walls is a storage grid 32. This consists of conventionally interlocked spaced vertical members 33 and horizontal members 35. These can be interlocked, glued, adhesed or otherwise secured to form a plurality of compartments, all of which share a common rear wall 34.

Each of the compartments is designated 36. The grid members both horizontally and vertically may extend the full depth of the sidewall 23S or they may extend forwardly from the rear wall 23R to occupy only a portion of the depth of the storage section 23 as may be desired. Optionally as shown on most of the compartments 36 is a face plate 37 or 39. The difference between the two, being the shape of the cutouts 37C or 39C as per FIG. 3. These cutouts are configured and sized to receive a lipstick tube.

The vertical members 33, and horizontal members 35 of the grid 32 may be made of any suitable material, e.g. plastic, wood, or metal. The same is true for the face plates 37, 39, which may be secured in place in a conventional manner as by glueing adhesing, welding etc.

The storage section 23 is preferably occupied only in part by the compartments 36 of the grid 31. See FIG. 3 for example. Disposed either beneath, or above the grid 31 is the cooling zone 40 to be described subsequently.

In FIGS. 5 it is seen that the grid members 35 may be tilted downwardly rearwardly which angularity for reasons to be set forth is deemed preferable to a fully horizontal member 35. By tilting the horizontal members 10 degrees to 45 degrees rearwardly and downwardly the lipsticks 50 will when inserted into a compartment 36, slide rearwardly by gravity into the confines of the respective compartment.

Disposed beneath the grid 32 is the cooling zone 40. It is a storage zone whose temperature is controlled by thermostat 42 (FIG. 3) which is mounted either on door 43 or on a panel adjacent a cut out corner of door 43. Door 43 is hingedly attached by hinges 41 to bottom wall 23B. Access to the interior of cooling zone 40 is gained by opening door 43 by handle 45 at the center top thereof, and pulling downwardly. Zone 40 is in refrigerant communication with refrigeration section 12 through ducting and piping of a conventional nature. A lipstick, L, after use would be placed in the interior of this cooling zone 40 and cooled down to about 32/42F. at which time it is not as free flowing and smearable as if it were at ambient temperature.

Alternatively, cooling zone 40 need not be in refrigerant communication with refrigerant section 12. In such alternate version, thermostat 42 can be omitted. Instead of cooling the lipstick in the cooling zone, a separate refrigerated container may be employed to house the lipstick, L, to be cooled, said refrigerated container, itself being stored in the cooling zone 40. A typical refrigerated container for a lipstick which can be employed in this invention is the container disclosed and claimed in U.S. Pat. No. 4,393,975. Since such a container is known in the art a further description need not be set out. Suffice it to say that the portion of the specification specific to that device is set out in the aforementioned U.S. patent and is incorporated herein by reference. Of course, no reason is seen why the container of U.S. Pat. No. 4,393,975 cannot be used in conjunction with a refrigerated cooling zone 40 and such combination is also contemplated herein.

Figure 7:
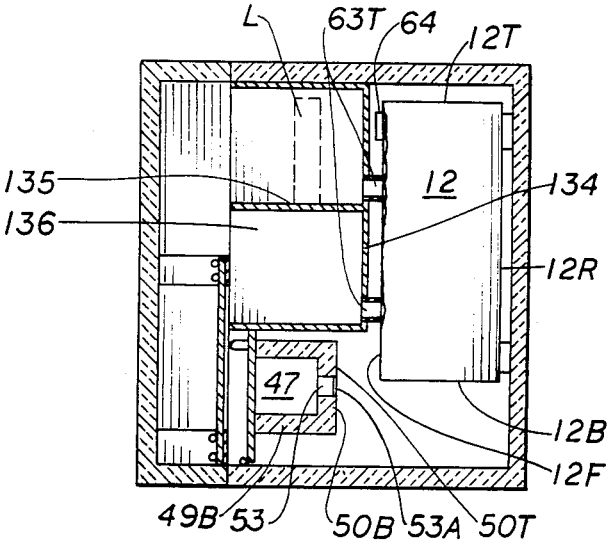
FIG. 7 is a sectional view similar to FIG. 5 but of a variant interior.

In FIGS. 5 and 7 we see that the cooling zone 40 is formed by and defined as the volume within the spaced top and bottom walls 49T and 49B respectively and the spaced upper and lower rear wall segments 50T and B. The side walls of the cooling zone being the segments of the side walls 23S that fall within the spacing between top and bottom walls 49T and B. Thus refrigerated air can blow into the compartment through space 53 between rear wall segments 50T and 50B.

In order to provide for separate temperature control of the cooling zone, space 53 will have to be closed off by wall 53A to form a segregated compartment. To achieve separate temperature control for the storage section a second thermostat (not seen) will be needed. The hookup of such, and the other necessary components are deemed conventional. If not employed, the one thermostat 42 will control the temperature of the entire storage section.

In FIG. 7, which is a view similar to FIG. 5, but with a different grid pattern 132. Here the lipsticks (L) are intended to be stood up vertically. Thus the grid members 133 and 135 are sized and spaced to accommodate standing lipsticks. For this reason the grid 132 only includes 3 spaced horizontal members as opposed to the 4 of the FIG. 5 embodiment where the lipstick (L) lie down.

Figure 10:
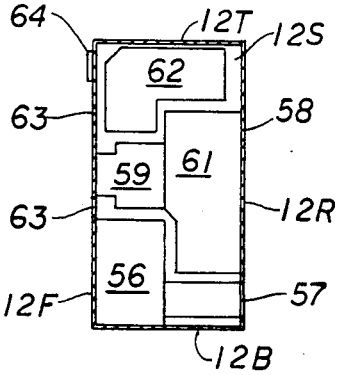
FIG. 10 is a sectional view of the mechanical refrigeration portion of this invention in close-up.

Within the refrigerator unit 12 are provided the various elements shown in FIG. 10. Thus there is provided a compressor 56 located in the refrigerator compartment 12, which compartment has a top wall 12T, two side walls 12S, a spaced bottom wall 12B and a rear wall 12R, and a front wall 12F. A condenser cooling air inlet 57 and a warm air exit 58, a fan 59, a condenser 61 and an evaporating unit 62 through which the cooling air is passed through apertures 63 into the storage compartment 23, and to the cooling zone 40 in the FIG. 5 embodiment, and tubes 63T for delivery of cool air in the FIG. 7 embodiment. A return 64 having an opening 64 for passage of warm air back to the refrigeration zone is also shown.

In FIG. 7 the tubes 63T pass through the rear wall 134 of the grid 132 whereas in the FIG. 5 embodiment the apertures 63 communicate with and through main rear wall 23R.

Since the blowup of FIG. 10 represents both the versions shown in FIGS. 5 and 7 neither the apertures 63 or tubes 63T are shown in the view, though they are present in the respective FIG. 5 and FIG. 7 embodiments.

Since the refrigeration section 12 is electrically operated, there is shown a cord 54 with a plug 55, in FIG. 3, which cord is attached and electronically converted to various electrical components described with respect to FIG. 10. The operation of a refrigeration section is deemed conventional and further details are beyond the scope of this patent application.

It is seen that I have provided an apparatus to cool lipsticks immediately after usage and for their continuous storage between usages. The device can be made of any suitable combination of materials, such as wood, metal and plastic as may be desired.

Figure 11:
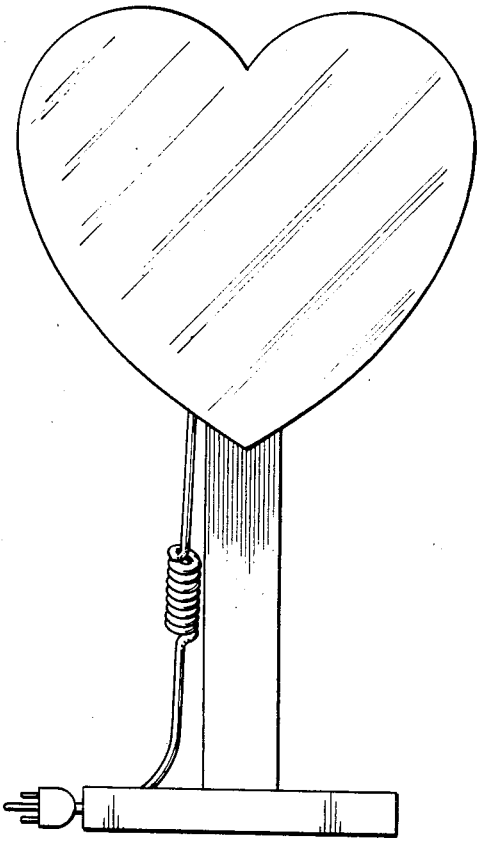
FIG. 11 is a front elevational view of an alternate embodiment of this invention.
Figure 12:
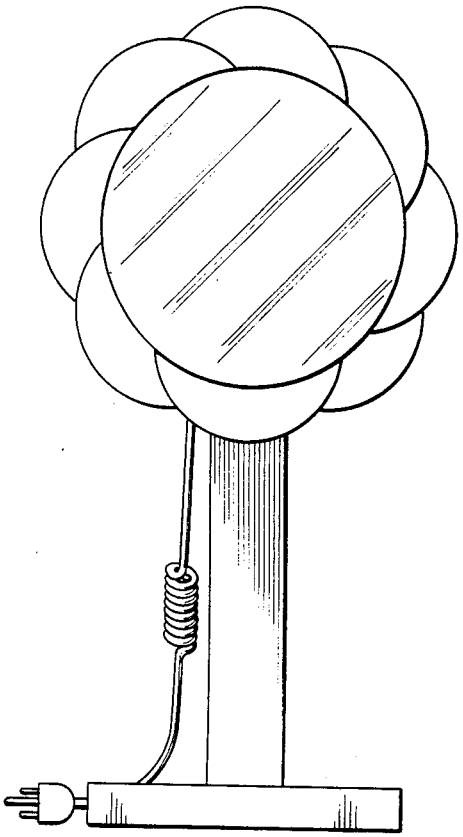
FIG. 12 is a front elevational view of second alternative embodiment of the invention.

While the discussions above all pertain to a lipstick storage apparatus that is generally rectangular in configuration, reference to FIGS. 11 and 12 show but two of the other numerous configurations that are possible for the instant apparatus.

The variant of FIG. 11 features a heart shaped refrigerator section 333, while the embodiment of FIG. 12 is the circular and fancifully decorated refrigerator section 223. Mechanically these are similar to the front embodiment described herein with the refrigeration section exterior to the storage section, rather than being built in.

It is also to be seen that any and all of the compartments of these may include or exclude the face plate previously discussed.

Figure 13:
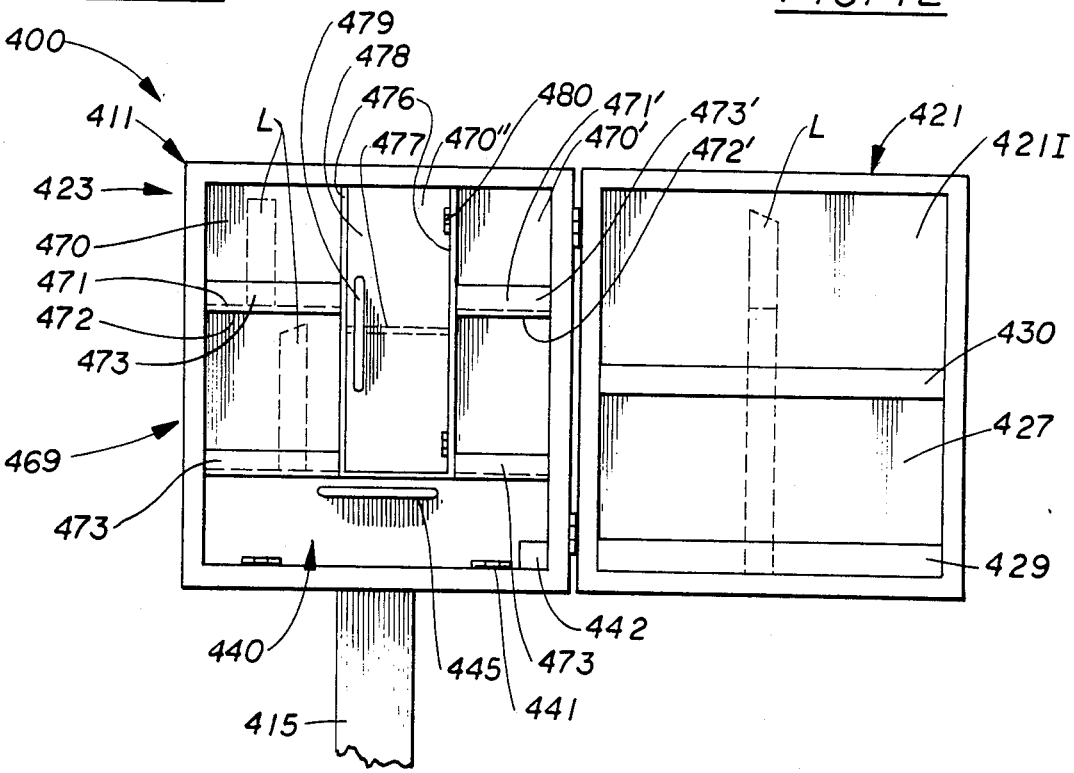
FIG. 13 is a front elevational view of a third alternate embodiment of this invention.

Embodiment 400 shown in FIG. 13 is in many ways similar to embodiment 10 shown in FIG. 3. The area of differentiation is in the storage compartment 423.

In the discussion of this embodiment, numbers in the 400 series that have their last two digits similar to parts previously discussed which bear the same two digit identifier, are like parts. If any slight deviations exist they will be pointed out.

Thus embodiment 400 includes a base 414, on which is mounted a stand post 415. Secured to the stand post 415 is storage compartment 423. The first door 421 is similar to door 21 and it is hinged in like fashion. While shown as a left hand opening door, obviously the unit could be right hand opening as well. This is of course true for all of the other embodiments as well.

The interior 421l of the door 421 is configured in like manner as the door shown in FIG. 3. For ease of understanding the holders which would be 431 are not shown. Elements 427, 428, 429 are 430 are the same as their two digit counter parts. Thus added discussion is not needed.

The interior of storage section 423 is of a simpler design. It features a cooling zone at the bottom, 440 that is non-compartmented on its interior. The zone 440 has a downwardly pivoting door 443 held by hinges 441. The thermostat 442 is conveniently disposed in the lower right corner of door 443. Handle 445 mounted conventionally permits access to the interior of the cooling zone, for the storage of nail polish or lipstick.

Storage section 423 instead of a grid portion 32 it has an upper storage zone 469. This upper storage zone is trifurcated into three compartments, 470, 470' and 470''. The first two compartments 470 and 470' constitute the left larger and the right smaller compartments with the doored compartment 470'' therebetween.

Each of the two outer compartments 470 and 470' includes a pair of vertically spaced shelf unit 471 and 471' respectively. Each shelf unit has a horizontal shelf member 472, 472' and a front upstanding guard rail 473, 473'. Optionally, individual retainers or holders may be provided for the storage of individual lipstick tubes.

Disposed between the two compartments 470 and 470' is a third compartment 470''. This compartment has a pair of spaced vertical side walls 476 which also serve as the interior walls of the two compartments 470 and 470' respectively. Mounted on each of the two side walls 476 within compartment 470'' are a plurality of vertically spaced shelf ledges, of any conventional style, similar to those used in medicine cabinets for holding shelves therein. In FIG. 13, the shelf is depicted as being on a lower elevation than are the upper shelves of compartments 470 and 470''. Such is not a limitation however. A door 478 is suitably hinged on hinges 480 and having a door handle 479 is employed to close off and gain access to the middle compartment 470''.

Nail polish, lipsticks and other items may be stored in this middle compartment which is cooled by the refrigeration mechanism mounted on the rear of the cabinet 411 in a refrigeration portion 412, not seen but of the nature of the refrigeration portion 12 previously discussed.

In this embodiment 400 the cabinet 411 is in refrigeration communication to the refrigeration mechanism such that the entire interior, including the three compartments 470, 470' and 470'' as well as the cooling zone 440 are refrigerated. Obviously the door area will be cooled as well.

Figure 6:
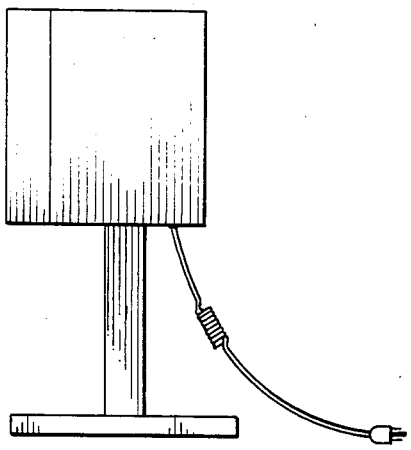
FIG. 6 is a side sectional view similar to FIG. 2 of a variant hereof.

As to the specifics of the refrigeration portion, the externally mounted version as shown in elevation in FIG. 2 is preferred over the internal configuration as shown in FIG. 6.

Also while not shown, the embodiment 400 would also have an external door handle 425, not seen that is conventional and similar to handle 25 per FIG. 1.

It is seen that this version of my invention, while not possessing as much storage space as the embodiments, wherein the lipsticks are stored horizontally, does indeed permit one to keep more than enough cooled lipsticks readily available. Also it permits the extra cooling in the cooling zone, which is optionally less insulated such that extra cooling can take place than in the balance of the interior of cabinet 411.

While only one thermostat has been disclosed, it is readily within the skill of the art to provide the cooling zone with a separate temperature control as may be desired.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. A refrigerator for lipsticks that includes:

a. a storage cabinet for lipsticks, b. a refrigeration generation section in cooling communication with said storage cabinet, c. a base comprising a vertical post attached to said storage section, and to a horizontal stand, said storage cabinet having a storage section, and a hingeable door hingedly connected to said storage section, said door including means for storing elongated lipstick tubes therein, and said storage section having a plurality of lipstick storage compartments, and means for carrying refrigerated air generated in said refrigerator section to said storage section and means for removing warm air from said storage section.

2. The apparatus of claim 1 wherein the storage cabinet also includes a lipstick cooling zone which zone is defined as a separate compartment for cooling down the temperature of a lipstick, said cooling zone being disposed either on top of or beneath the storage section in said cabinet.

3. The lipstick refrigerator of claim 2, wherein one or more of the compartments for lipstick includes a front plate with a cut out therein, said cutout conforming to the configuration of a lipstick tube.

4. The apparatus of claim 2 wherein the cooling zone is thermostatically controlled.

5. The apparatus of claim 4 wherein thermostat controls the temperature of the cooling zone and at least one compartment of said grid has an upstanding front plate with a cutout therein.

6. The apparatus of claim 2 wherein the cooling zone includes a removable refrigerated insert disposable therein to cool a lipstick within said insert.

7. The apparatus of claim 1 wherein the grid has horizontal and vertical members intersecting to form the plurality of compartments.

8. The apparatus of claim 7 wherein the horizontal members of the grid are coated rearwardly downwardly.

9. The apparatus of claim 1 wherein the hingeable door also includes lipstick storage means.

10. The apparatus of claim 1 wherein the refrigerator section is externally mounted abutting the storage section.

11. The apparatus of claim 1 wherein the refrigeration section is self contained within the storage section.

12. The apparatus of claim 1 wherein one or more compartments of the grid include an upstanding front plate with a cutout therein, said cutout conforming to he slope of a lipstick, and the hingeable door includes means for storing lipsticks therein.

13. The apparatus of claim 12 wherein a cooling zone is disposed beneath the storage section in said storage cabinet.

14. The apparatus of claim 13 wherein the cooling zone is thermostatically controlled.

15. The apparatus of claim 1 wherein the compartments of the grid are sized to receive lipsticks for vertical storage.

16. The apparatus of claim 1 wherein the compartments of the grid are sized to receive lipsticks in a horizontal disposition.

17. The apparatus of claim 1 wherein said storage section includes a grid forming a plurality of individual compartments, each of which is intended to store one lipstick.

18. The apparatus of claim 2 wherein said storage section includes a trio of horizontally disposed shelved compartments.

19. The apparatus of claim 18, wherein the middle of said compartments has a hinged door thereon.

* * * * *